United States Patent [19]

Pahl et al.

[11] Patent Number: 4,716,504

[45] Date of Patent: Dec. 29, 1987

[54] LIGHT FIXTURE BRACKET FOR SUSPENDED CEILING

[75] Inventors: Scott Pahl, North Andover; Luigi De Simone, Chelsea, both of Mass.

[73] Assignee: Keene Corporation, Union, N.J.

[21] Appl. No.: 25,496

[22] Filed: Mar. 13, 1987

[51] Int. Cl.[4] ..... F21S 1/02

[52] U.S. Cl. ..... 362/150; 362/365

[58] Field of Search ..... 362/148, 150, 250, 285, 362/365, 366

[56] References Cited

U.S. PATENT DOCUMENTS 3,081,398 3/1963 Karth ..... 362/150

4,646,212 2/1987 Florence ..... 362/150

*Primary Examiner*—Allen M. Ostrager

*Attorney, Agent, or Firm*—Kane, Dalsimer, Sullivan, Kurucz, Levy, Eisele and Richard

[57] ABSTRACT

A system for securing a light fixture to a grid of a suspended ceiling is described. The fixture has a cutout at each corner of its opposed sidewalls. The cutout is formed with vertically spaced, horizontal surfaces. A bracket has a plate with upwardly extending opposed legs disposed transverse to the plate. The legs are biased away from each other and are each provided with upwardy extending surfaces adapted to capture one of the horizontal surfaces of the cutout therebetween. The bottoms of the legs define feet adapted to sit on an associated grid member. The plate extends below the grid member so that the member is captured between the plate and the upwardly extending surfaces while flanges affixed to the legs engage the inside of the fixture to provide a positive engagement between the fixture and the grid.

8 Claims, 3 Drawing Figures

LIGHT FIXTURE BRACKET FOR SUSPENDED CEILING

BACKGROUND OF THE INVENTION

The present invention relates to a bracket for supporting a light fixture and in particular to a bracket for supporting such a fixture from a suspended ceiling grid member.

A currently popular form of ceiling utilizes a grid of members to support ceiling tiles. Light fixtures for such ceilings are preferably suspended in such a fashion that the lower face of the fixture is flush with a ceiling "tee" of the grid members and hence with the ceiling tiles, this gives a neat customized look to the installation.

Heretofore, such fixtures were commonly suspended from wires or rods secured to the ceiling superstructure. This is a relatively complex installation since it requires precise placement of the wires to insure that the fixture hangs properly. In some instances various forms of clips have been suggested however, the clips had to be precisely designed for the particular fixture and grid member to insure that the fixture would hang properly for that system. Another problem with such prior art systems arises as a result of building codes in many localities requiring "seismic" protection for hanging fixtures. That is, it is not sufficient for the fixture to merely hang in position but it must be secured in such a fashion that an earth tremor or quake would not dislodge the fixture. Accordingly, some positive engagement between the grid and fixture must be provided.

In view of the above, it is the principal object of the present invention to provide improved means for supporting light fixtures in a suspended ceiling system.

A further object is to provide a simple bracket for use in such a ceiling which readily permits the height of the fixture to be readily adjusted within a given range.

A still further object is to provide such a bracket which may readily and easily be installed in position.

Still another object is to provide such a bracket which provides seismic protection for an associated fixture.

SUMMARY OF THE INVENTION

The above and other beneficial objects and advantages are attained in accordance with the present invention by providing a light fixture for a suspended ceiling system with a bracket cutout at opposite ends of each sidewall thereof. The cutout is formed so that on opposite sides there are downwardly directed horizontal surfaces spaced vertically apart from each other. A bracket is provided comprising a vertical plate having a pair of legs along opposite sides thereof. The legs are spring biased away from each other. Each of the legs includes at its upper end surfaces for engaging the horizontal surfaces of the fixture sidewall cutout. The legs terminate in feet adapted to rest on top of a ceiling grid member and thereby support the fixture in position. The vertical plate and the engaging surfaces of the bracket leg are spaced apart from each other so that the ceiling grid member is captured therebetween. The vertical position of the fixture with respect to the grid member is determined by which of the fixture horizontal surfaces are engaged by the bracket legs.

DETAILED DESCRIPTION OF THE PREFERRED EMBODIMENT

Figure 1:
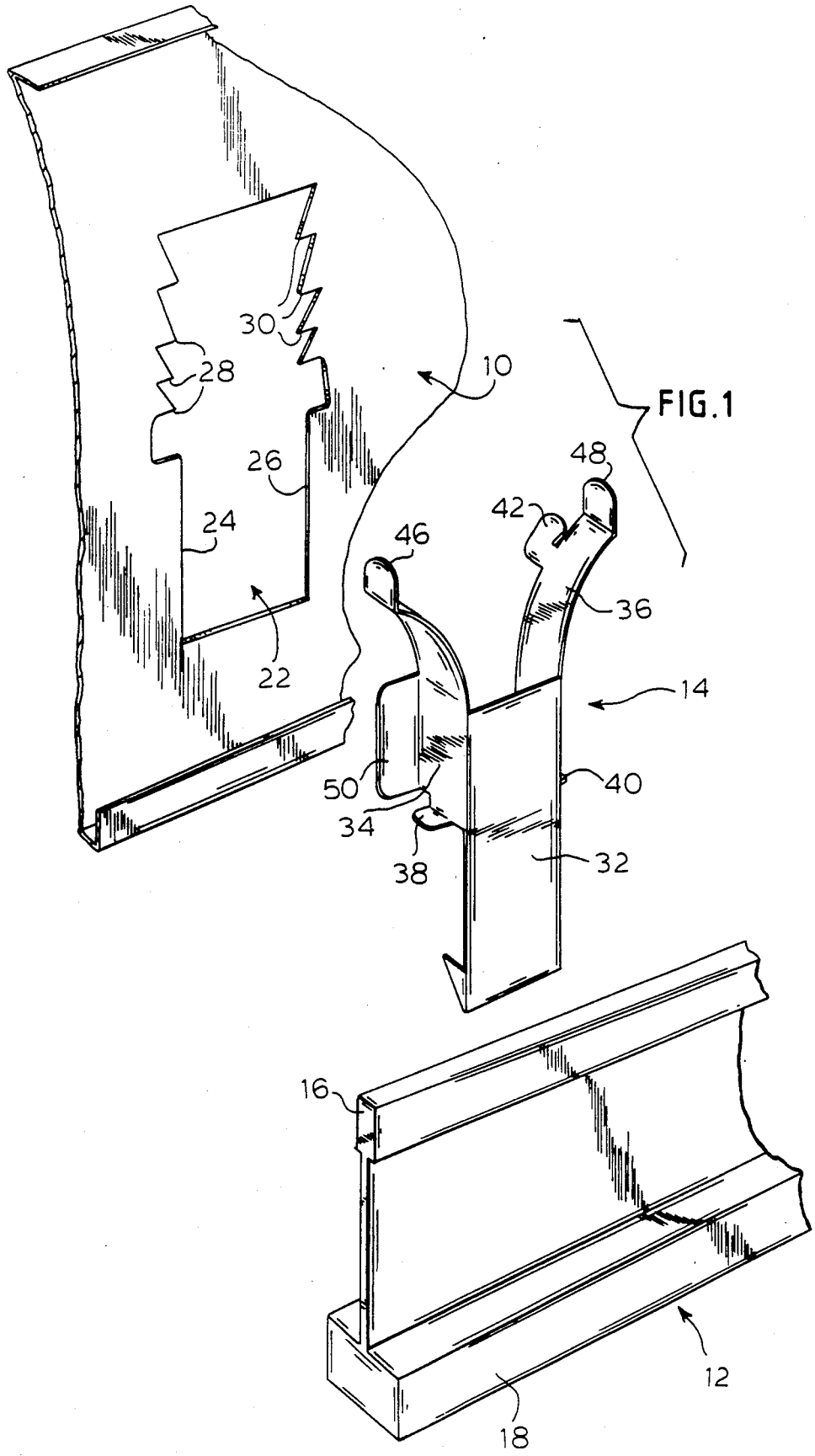
FIG. 1 is an exploded view of a fixture and bracket in accordance with the present invention and an associated grid member.
Figure 2:
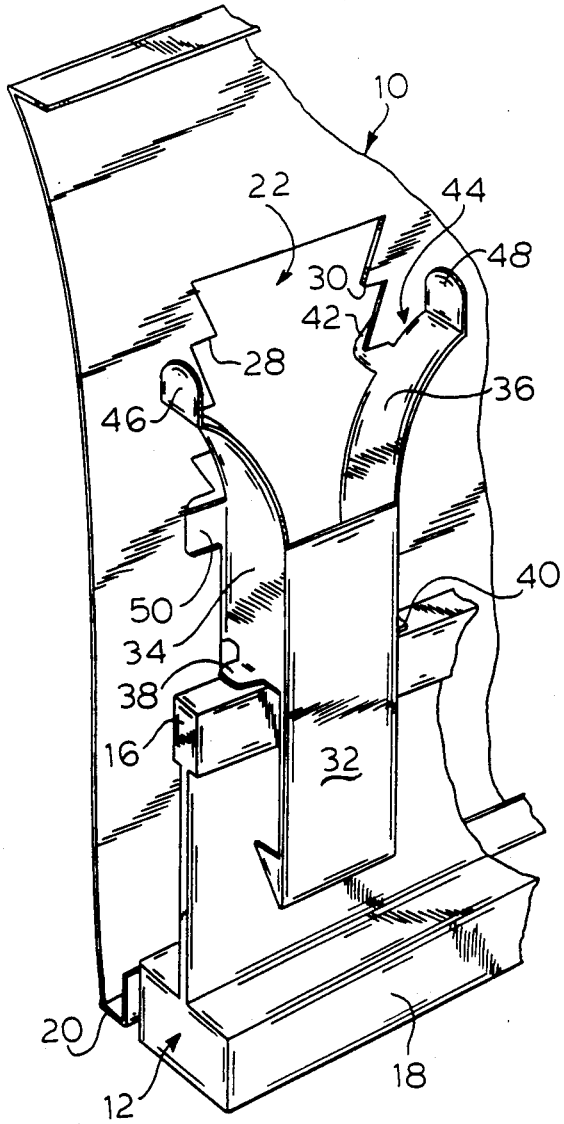
FIG. 2 is a perspective view of the components of FIG. 1 in assembled position.

Reference is now made to the drawings wherein a light fixture 10, ceiling grid member 12 and a hanger bracket 14 for securing the fixture 10 to the grid member 12 are depicted. The grid member 12 is of a conventional "tee" configuration having a top "tee" or bulb 16 and a bottom or ceiling "tee" 18. The ceiling tiles (not shown) rest on the upper flanges of the ceiling "tee" 18 to form a suspended ceiling. As stated, it is desirable to have the lower end 20 of fixture 10 flush with the bottom end of the ceiling "tee" to provide a neat, finished look to the ceiling.

In accordance with the present invention a cutout 22 is provided at each end of each sidewall of the fixture. It will be appreciated that while only one such cutout is shown, a minimum of four would be required. The cutout 22 is formed so that on opposed vertical surfaces 24, 26 there are a series of vertically spaced, horizontal surfaces 28, 30. It should be noted that the horizontal surfaces 28, 30 are arranged in pairs.

Bracket 14 is preferably formed of a single metal stamping of stainless or spring steel. The bracket includes a vertical plate 32 and a pair of legs 34, 36 which are transverse to the plane of the plate 32. As shown, the legs 34, 36 extend upwardly above the plate 32 and are curved and biased away from each other. A pair of feet 38, 40 extend away from each other at the bottoms of legs 34, 36.

Figure 3:
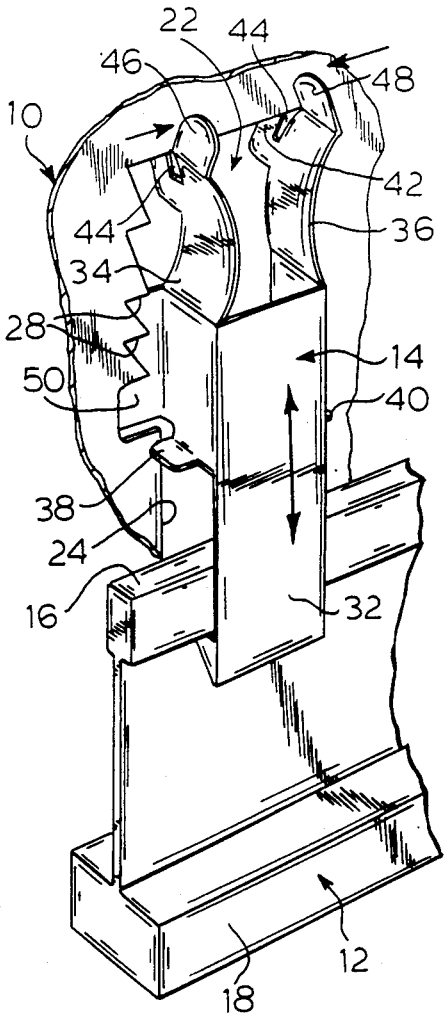
FIG. 3 is a view similar to FIG. 2 depicting the components in position for making adjustments.

At the upper end of each of legs 34, 36 there is a transverse projection 42. A downward slit 44 in projection 42 defines a slot the lower end of which is designed to engage one of the horizontal surfaces 28, 30 thereby capturing a portion of the fixture on opposite sides of the slot. The feet 38, 40 then support the fixture on grid member 12 by resting on the top surface of top tee 16. It should be readily appreciated that the lower edge 20 of the fixture may be adjusted by adjusting which pair of horizontal surfaces 28, 30 is captured within the slots of legs 34, 36. To this end, a pair of finger tabs 46, 48 are provided at the top of legs 34, 36. By compressing the tabs, as shown in FIG. 3, the position of the bracket and hence the height of the fixture may be adjusted.

An important aspect of the present invention resides in the fact that a portion of plate 32 depends below feet 38, 40. As will be noted, this portion extends below the top tee 16 of grid member 12 and hence cooperates with the slots of legs 34, 36 in capturing the grid member therebetween. Flanges 50, transverse to the legs and parallel to plate 32, engage the inside of the fixture to aid to secure the fixture. This forms a positive clip which cannot loosen during an earthquake or similar shock and hence serves to prevent the fixture from sliding off the grid member in the event of a shock.

Thus, in accordance with the above the aforementioned objects are effectively attained.

Having thus described the invention, what is claimed is:

1. In combination, a light fixture having a sidewall with a bracket engaging opening therein, said opening being defined with a plurality of vertically spaced bracket engaging means arranged in pairs therein, and a bracket for securing said fixture to a ceiling grid member; said bracket including:

a vertical plate;

a pair of spaced legs extending from said plate disposed transverse to said plate along opposite sides thereof, said legs being biased away from each other;

fixture engaging means on each of said legs adapted to interengage with said bracket engaging opening, said fixture engaging means becoming disengaged when said legs are urged towards one another; and, feet members on each of said legs spaced downwardly of said fixture engaging means and adapted to rest on a top surface of said grid member, the vertical position of said fixture with respect to said grid member being determined by which of said pairs of bracket engaging means interengages with said fixture engaging means.

2. The invention in accordance with claim 1 wherein said fixture opening has opposed sides formed with vertically spaced, generally horizontal surfaces defining said bracket engaging means; said fixture engaging means comprising upwardly extending spaced surfaces for capturing one of said generally horizontal surfaces therebetween.

3. The invention in accordance with claim 2 wherein said opposed sides are symmetrical.

4. The invention in accordance with claim 2 wherein said generally horizontal surfaces are connected by diagonal surfaces.

5. The invention in accordance with claim 1 wherein said feet extend away from each other.

6. The invention in accordance with claim 2 wherein said plate depends below said grid member top surface and said upwardly extending surfaces and said plate are spaced apart from each other whereby to capture said grid member therebetween.

7. The invention in accordance with claim 6 wherein each of said legs has a flange affixed thereto, said flanges being directed away from each other and lying in a plane parallel to said plate.

8. The invention in accordance with claim 7 wherein said bracket is integrally formed of one piece of sheet metal.

* * * * *